United States Patent [19]

Evigan

[11] Patent Number: 5,057,975

[45] Date of Patent: Oct. 15, 1991

[54] APPARATUS FOR ILLUMINATING A KEYHOLE

[76] Inventor: Gregory R. Evigan, 19818 Ventura Blvd., Woodland Hills, Calif. 91364

[21] Appl. No.: 657,068

[22] Filed: Feb. 19, 1991

[51] Int. Cl.[5] ..... E05B 17/10

[52] U.S. Cl. ..... 362/100; 362/184; 362/234

[58] Field of Search ..... 362/100, 184, 185, 186, 362/191, 234, 253

[56] References Cited

U.S. PATENT DOCUMENTS

| | | | |
|---|---|---|---|
| 500,026 | 6/1893 | Morey | 362/100 |
| 2,242,626 | 5/1941 | Silker | 362/100 |
| 2,309,840 | 2/1943 | Garvert et al. | 362/100 |
| 2,676,244 | 4/1954 | Dittman | 362/100 |
| 3,590,234 | 6/1971 | Bartick | 362/100 |
| 3,719,821 | 3/1973 | Foreman | 362/100 |
| 4,234,909 | 11/1980 | Cotroneo | 362/100 |
| 4,295,052 | 10/1981 | Jochmann et al. | 362/100 |
| 4,310,873 | 1/1982 | Bean | 362/100 |
| 4,745,527 | 5/1988 | Belverio, Jr. et al. | 362/100 |
| 4,777,570 | 10/1988 | Littles | 362/100 |

*Primary Examiner*—Stephen F. Husar

*Attorney, Agent, or Firm*—Seed and Berry

[57] ABSTRACT

A retrofittable apparatus for illuminating the face of a lock comprised of an annular outer housing with an aperture which receives the lock cylinder such that when the cylinder's face is within the outer housing a gap is formed between a housing front wall and the cylinder front face. An annular body having an aperture accepts the lock cylinder such that a shoulder of the body engages a lock cylinder flange. A lamp illuminates the face of the lock cylinder through the gap when a switch is closed. In the preferred embodiment the outer housing forms part of the electrical path from the battery supply to the lamp.

6 Claims, 3 Drawing Sheets

FIG. 1
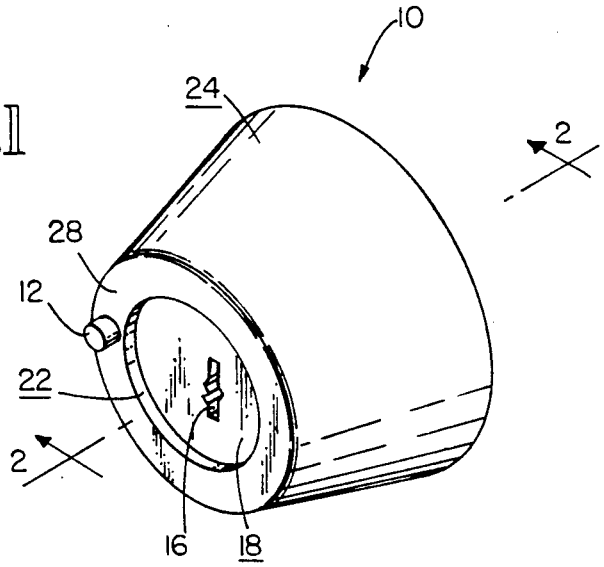
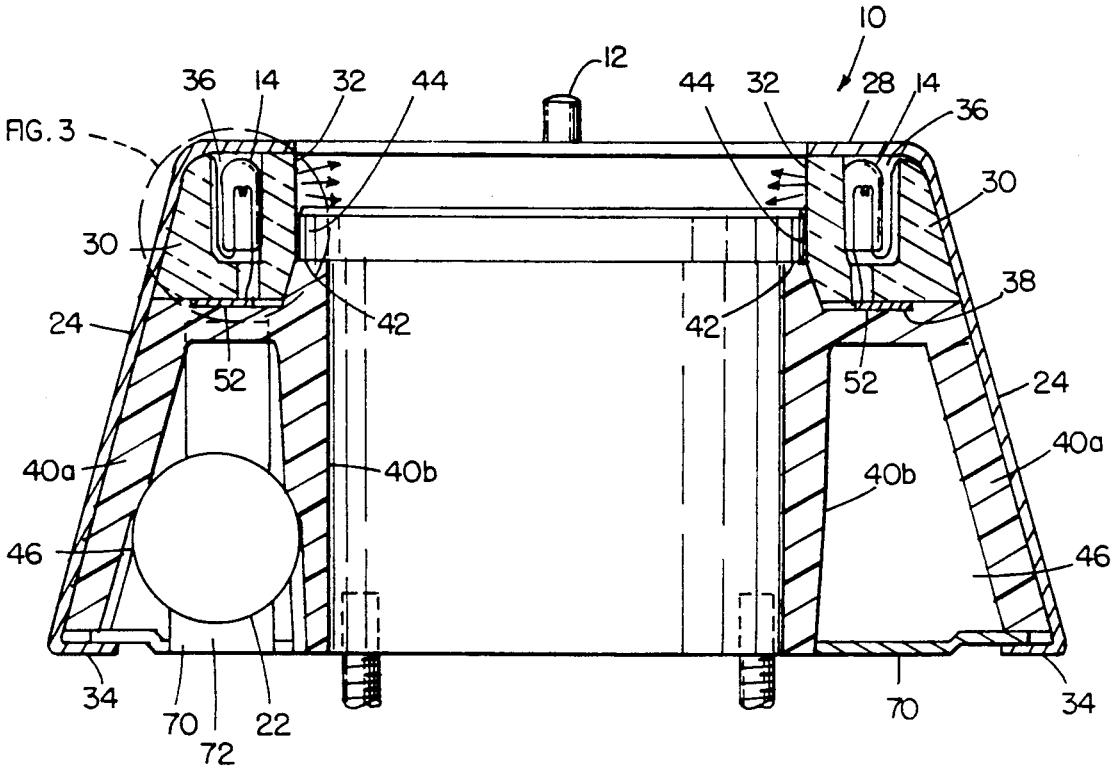
FIG. 2

FIG. 3
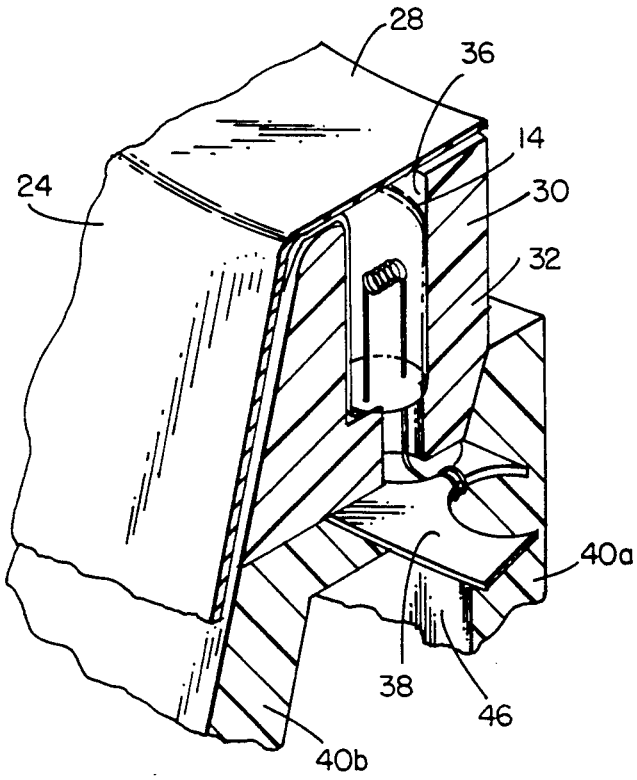
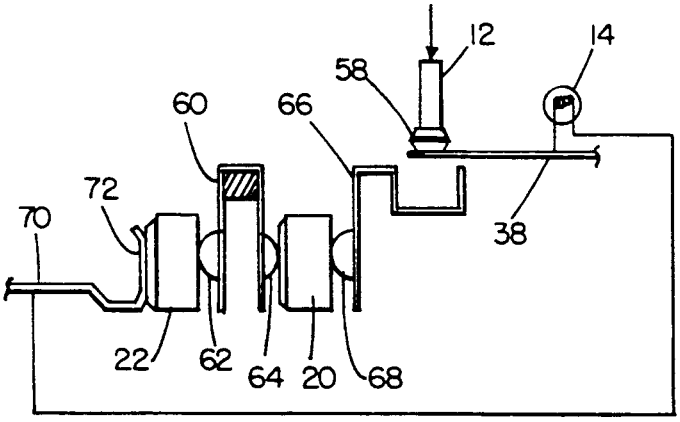
FIG. 5

APPARATUS FOR ILLUMINATING A KEYHOLE

TECHNICAL FIELD

The present invention relates to illumination devices, and more particularly, to an apparatus for illuminating keyholes.

BACKGROUND OF THE INVENTION

Numerous types of locks are currently available for securing the doors of homes and businesses. Probably the most widely used lock is the so-called deadbolt lock. Deadbolt locks have achieved widespread use because of the high degree of security that they provide, the ease with which they are operated and installed, and their relatively pleasing aesthetic appearance. Indeed, the deadbolt lock has become so common that doors and door frames are frequently prefabricated to accept them. Their acceptance has resulted in a substantial standardization of deadbolt locks, with the major brand name locks usually being interchangeable and with the lesser-known brands typically being direct replacements for their better known counterparts.

One of the few problems with deadbolt locks is the difficulty of locating the keyhole opening in the dark. This problem may be compounded by the large number of keys that one seeking entry may carry. One method of reducing this problem is to illuminate the keyhole opening. Prior art devices for providing keyhole opening illumination exist, such as those described in U.S. Pat. No. 4,310,873, issued to Bean, entitled "Keyhole Light Illuminator," and in U.S. Pat. No. 4,745,527, issued to Belverio, Jr., et al., entitled "Illuminated Door Lock Scratch Guard." While these, and other, devices are useful, they typically use a larger surface area for mounting than may be available with a deadbolt lock. These devices also alter the appearance of the door and lock arrangement with which used and may adversely affect the aesthetics of the door. Also, the devices are difficult to securely mount on the door. Such prior art devices are also needlessly difficult to fabricate, particularly when making connections with the illumination lamps.

SUMMARY OF THE INVENTION

It is an object of the present invention to provide an apparatus for illuminating a keyhole opening.

It is another object of the present invention to provide an apparatus for illuminating a keyhole opening that is easily used with existing locks.

It is yet another object of the present invention to provide an easily assembled apparatus for illuminating a keyhole opening.

These and other objects of the present invention which will become apparent from the following detailed description and the accompanying drawings are achieved by a conversion apparatus which selectively illuminates a lock using a battery. The apparatus includes an annular outer housing having an aperture which accepts the cylinder of the lock such that when the cylinder is in place, its front face is within the housing and a gap is formed between the front of the housing and the cylinder's face. An annular body within the outer housing also has an aperture dimensioned to accept the cylinder such that a shoulder of the body engages a flange on the cylinder. A lamp in the housing lights the cylinder front face when a switch is actuated. The outer housing further includes a rear wall which retains the body within the outer housing and which contacts the door when the lock is assembled.

Preferably, the outer housing is part of the conductive path between the battery and the lamp and the battery is housed within a chamber of the body. Even more preferably, the outer housing encloses a transparent, insulating light ring which contains the lamp. Most preferably the apparatus utilizes the same mounting method as the existing lock.

BRIEF DESCRIPTION OF THE DRAWINGS

FIG. 1 is an isometric view of a preferred embodiment of the present invention in use on a typical deadbolt lock cylinder having a keyhole opening.

FIG. 2 is an enlarged sectional view of the invention taken substantially along line 2—2 of FIG. 1.

FIG. 3 is an enlarged, fragmentary isometric view of the portion of the invention shown encircled in FIG. 2.

FIG. 5 is a diagram of the switch mechanism of the invention of FIG. 1.

DETAILED DESCRIPTION OF THE INVENTION

Figure 4:
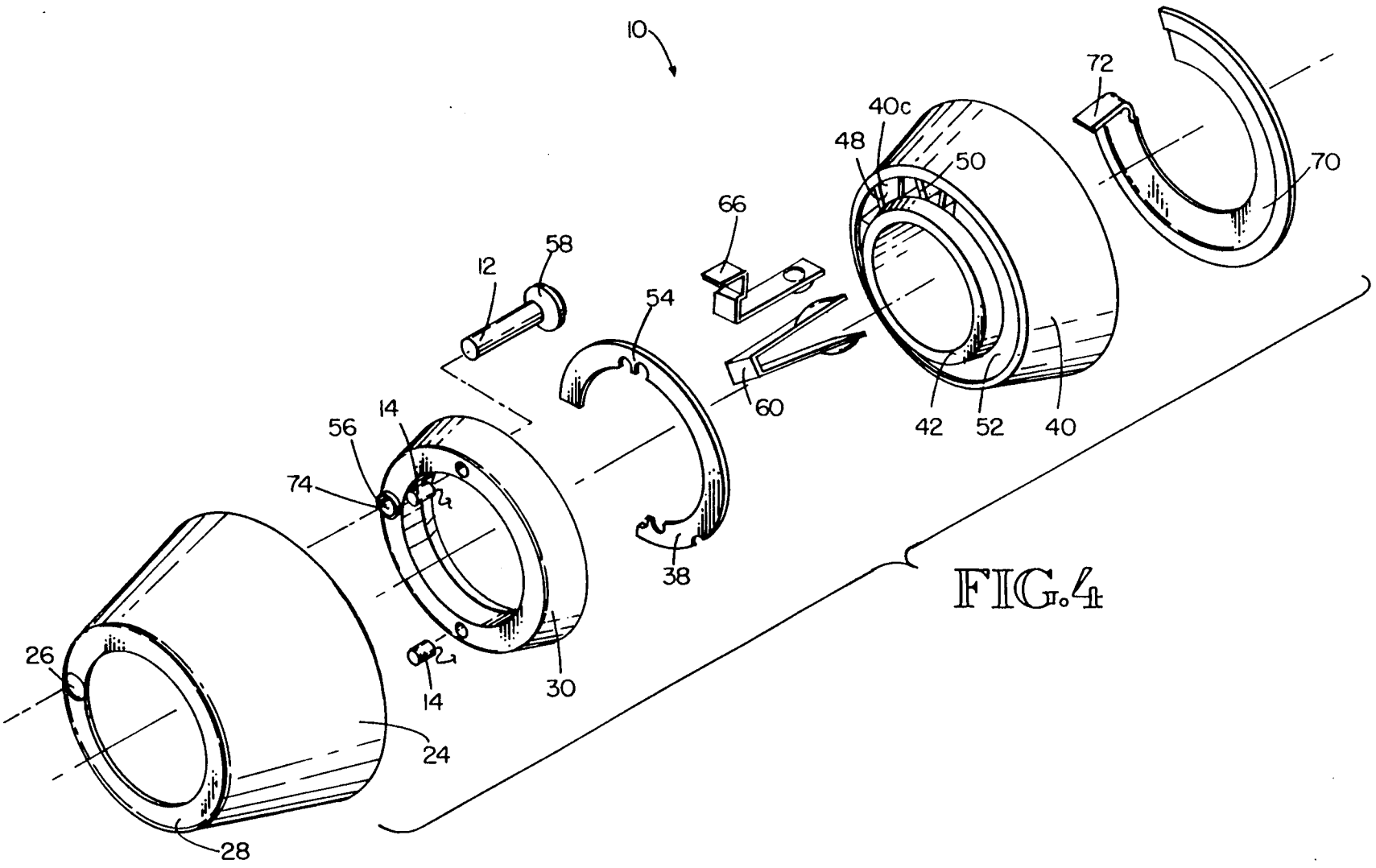
FIG. 4 is an exploded view of the invention of FIG. 1.

As shown in the drawings for purposes of illustration, the present invention is a keyhole opening illumination apparatus 10. In a preferred embodiment, a plunger 12 is depressed to switch current to a pair of incandescent lamps 14 which illuminate a keyhole opening 16 of a deadbolt lock cylinder 18. Power for the lamps is supplied by replaceable button-type alkaline batteries 20 and 22 stored within the apparatus 10. According to one preferred embodiment, an outer housing 24 of the apparatus 10 forms a part of the electrical path from the batteries to the lamps.

As best shown in FIG. 1, the outer housing 24 is an annular, generally frustoconical shaped enclosure which is fabricated from a conductive material, preferably brass. The outer housing 24 has a hole 26 in a front edge wall 28 through which the plunger 12 protrudes. The outer housing 24 has a central aperture through which the cylinder 18 is positioned. The keyhole opening 16 is on the front face of the cylinder and is orientated toward the front edge wall 28. When the cylinder 18 is in position, its front face is recessed from the front edge wall 28 of the outer housing 24 and a transparent inner ring 30 within the outer housing 24 has an annular wall 32 from which light is emitted, as is described below. The outer housing 24 has a back edge wall 34 (shown in FIG. 2) of a larger diameter than the front edge wall 28. In use, the back edge wall 34 contacts a front surface of a door on which the apparatus 10 is installed and retains the other components within the outer housing 24. The apparatus is held in place by two bolts (not shown) which are threadably received in the cylinder 18, as is standard practice with deadbolt locks.

A cutaway view of the apparatus 10 is shown in FIG. 2. This view reveals the two lamps 14 which emit light through the wall 32. These lamps 14 are mounted in recesses 36 in the inner ring 30, which is nonconductive, transparent, and designed to abut the inner side of the front edge wall 28. Adjacent to the rear of the inner ring 30 is a switch plate 38 made of a resilient, conductive material with a "C" shape.

Referring now to FIGS. 2 and 3, one terminal of each lamp 14 is electrically connected to the switch plate 38.

The switch plate 38 is held in place by a nonconductive plastic body 40. The plastic body 40 has a shoulder 42 against which a circumferential flange 44 of the cylinder 18 abuts when the apparatus 10 is installed on a door. As best shown in FIG. 2, the other terminal of the lamp 14 is bent upward, running to above the lamp 14, and is folded over the top part of the inner ring 30. When the inner ring 30 is positioned in the outer housing 24, the bent lamp terminal contacts the outer housing 24 and forms an electrical connection with the lamp terminal.

The overall construction and assembly of the apparatus 10 is best explained with the assistance of FIGS. 2 and 4. The plastic body 40 has a plurality of chambers 46. The chambers 46 are defined by an outer wall section 40*a* and an inner wall section 40*b* of the plastic body 40. A plurality of ribs 48 (shown in FIG. 4) extend radially between the upper portions of the inner and outer wall sections 40*a* and 40*b*, respectively. Openings 40*c* are formed between at least several of the ribs 48 at the upper end thereof. The top edge surface 50 of each rib 48, adjacent to openings 40*c*, is recessed from an adjacent top surface 52 of the body 40. Except in the area above the openings 40*c*, whereat a flexible end portion 54 of the switch plate 38 is positioned, the top surface 52 supports the switch plate 38. The switch plate end portion 54 extends over the ribs' top edge surface 50 and is free to move toward the ribs 48, but is prevented from doing so by its resiliency.

The hole 26 in the outer housing 24 is positioned above the end portion 54 of the switch plate 38. The inner ring 30 has an opening 56 therein aligned with the hole 26. The plunger 12 projects through the hole 26 and the opening 56. It has a keeper 58 to prevent the plunger from being removed through the hole and opening. When assembled, the switch plate 38 is held in place by the top surface 52 of the plastic body 40 and its end portion 54 is in contact with the plunger 12.

One of the ribs 48 is straddled by a conductive U-shaped connector 60 having button contacts 62 and 64 (see FIGS. 4 and 5). Another of the ribs 48 is straddled by a generally L-shaped connector 66 having a button contact 68 (see FIGS. 4 and 5). A battery 20 (see FIG. 5) is positioned within one of the chambers 46 between the U-shaped connector 60 and the L-shaped connector 66 with the button contact 64 and the button contact 68 contacting the opposite terminals of the battery. The U-shaped connector 60, the L-shaped connector 66, and their respective ribs 48 are arranged such that when the plunger 12 is pressed down, the end portion 54 of the switch plate 38 is bent into contact with the L-shaped connector 66.

Behind the plastic body 40 is located an electrically conductive baseplate 70. The baseplate 70 is a resilient "C" shaped clip having one end bent at a 90° angle to form a tab 72. This tab 72 fits into one of the chambers 46 which is sized to secure the battery 22 (see FIGS. 2 and 5). and is is dimensioned to contact one terminal of the battery 22 when the apparatus 10 is fully assembled. The other terminal of the battery 22 is in contact with the button contact 62 of the U-shaped connector 60. As previously described, the other button contact 62, contacts the battery 20. In a fully assembled apparatus 10, the baseplate 70 forms an electrical connection with the outer housing 24. Therefore, the baseplate 70 and the outer housing 24 form an electrical conductor between the batteries 20 and 22 and the terminal of each of the two lamps 14 which is in electrical contact with the outer housing. The batteries 20 and 22 can easily be removed from their chambers 46 when the apparatus 10 is not installed on a door since they align with the missing portion of the baseplate 70.

Still referring to FIG. 2, the back edge wall 34 of the outer housing 24 retains the plastic body 40 within the outer housing. The baseplate 70 thus serves as a closure for the chambers 46 containing the batteries 20 and 22. When the apparatus 10 is mounted on a door, the two mounting bolts pass through the door and connect to the cylinder 18. When these mounting bolts are tightened, The flange 44 of the cylinder 18 contacts the shoulder 42 of the plastic body 40. Further tightening causes the back edge wall 34 of the outer housing 24 to be pulled tightly against the front surface of the door.

The electrical connections of the apparatus 10 are better understood with reference to FIG. 5. As previously indicated, the tab 72 of the baseplate 70 makes an electrical connection with the battery 22 and with the battery 20 via the U-shaped connector 60. In this preferred embodiment, the plastic body 40 has two adjacent chambers 46, each housing one of the batteries. However, in another embodiment, not illustrated, three batteries are connected in series by use of two u-shaped connectors and are located in adjacent chambers in the body.

When the plunger 12 is pushed, the switch plate 38 is flexed and forms an electrical connection with the L-shaped connector 66. The lamps 14, each having one terminal connected to the switch plate 38, are then electrically connected to the batteries 20 and 22. The other lamp terminal is connected to the conductive outer housing 24, which is in electrical contact with the baseplate 70, which is in electrical contact with the batteries. The lamps 14 then illuminate the keyhole opening 16 by emitting light through the wall 32 of the transparent inner ring 30. In this preferred embodiment, the two lamps are connected in parallel and the plunger 12 is metallic. To electrically isolate the plunger 12 from the housing 24, a plastic insert 74 is used.

The apparatus 10 is designed to be retrofit onto existing deadbolt locks. To install the apparatus 10, the deadbolt lock is removed by unbolting the two mounting bolts. The deadbolt cylinder 18 is then slid out from the front of the door and the existing outer housing removed and replaced with the pre-assembled apparatus 10. The apparatus 10 and the deadbolt cylinder 18 are then reinstalled on the door using the same mounting bolts. When the batteries 20 and 22 wear out, after about one year of normal use, the deadbolt lock can be disassembled and the apparatus 10 removed. The old batteries can then be removed and replaced with new, and the deadbolt lock reassembled.

It will be appreciated that, although a specific embodiment of the present invention has been described herein for purposes of illustration, various modifications may be made without departing from the spirit and scope of the invention. Accordingly, the present invention is not to be limited except by the appended claims.

I claim:

1. A conversion apparatus to adapt an unlighted lock having a cylinder with a flange and a front face to a lock selectively illuminable using a battery, said apparatus comprising:

an annular outer housing having a housing front wall and an aperture dimensioned to accept the lock cylinder therein such that the cylinder front face locates within said outer housing, said outer housing further having a rear wall positionable to contact a door;

an annular body positioned within said outer housing and held in place therein by said front and rear walls, said body having an aperture dimensioned to accept the lock cylinder therein and a shoulder to engage the flange of the lock cylinder and hold the cylinder front face recessed from the housing front wall, said body further having a chamber dimensioned to accept the battery;

illumination means positioned within said outer housing for illuminating the cylinder front face; and switch means supported by said outer housing for selectively energizing said illumination means from the battery.

2. The apparatus according to claim 1 wherein:

said outer housing is electrically conductive;

said illumination means includes a lamp having first and second terminals, said first lamp terminal electrically contacting said outer housing;

said switch means selectively connecting said second lamp terminal to a first terminal of the battery; and connector means for electrically connecting said outer housing to a second terminal of the battery.

3. A conversion apparatus to adapt an unlighted lock having a cylinder with a flange and a front face to a lock selectively illuminable using a battery, said apparatus comprising:

an annular outer housing having a housing front wall and having a central aperture dimensioned to accept the lock cylinder therein such that the cylinder front face locates within said outer housing, said outer housing further having a rear wall positionable to contact a door;

an annular light ring positioned within said outer housing and adjacent the inner side of said housing front wall, said light ring having a central aperture dimensioned to accept the lock cylinder;

a lamp within said light ring selectively having current flowing through first and second terminals thereof to emit light through said light ring onto the cylinder front face;

an annular body positioned within said outer housing and held in place therein by said front and rear walls, said body having a central aperture dimensioned to accept the lock cylinder therein and a shoulder to engage the flange of the lock cylinder and hold the cylinder front face recessed from the housing front wall, said body further having a chamber dimensioned to accept the battery;

conductor means for conducting current from the battery to said lamp terminals; and switch means supported by said outer housing for selectively enabling current flow in said conductor means.

4. The apparatus according to claim 3 wherein said conductor means includes said outer housing.

5. The apparatus according to claim 4 wherein said outer housing electrically connects to said first lamp terminal and wherein said conductor means further includes:

a conductive baseplate electrically connected to said outer housing;

a switch plate electrically connected to said second lamp terminal and to said switch means; and means for connecting said baseplate to a first terminal of the battery and for connecting said switch means to a second terminal of the battery.

6. An apparatus for selectively illuminating a lock cylinder having a flange and a front face using a battery, said apparatus comprising:

a conductive annular outer housing having a housing front wall and having an aperture dimensioned to accept the lock cylinder therein such that the cylinder front face locates within said outer housing;

an annular light ring positioned within said outer housing adjacent the inner side of said housing front wall, said annular light ring having an aperture dimensioned to accept the lock cylinder;

a lamp within said light ring selectively having current flowing therein by way of first and second lamp terminals, said lamp emitting light onto said cylinder front face in response to said current flow, said first lamp terminal pinched between said light ring and said outer housing whereby an electrical connection between said outer housing and said lamp is formed;

an annular body positioned within said outer housing adjacent said light ring and having an aperture dimensioned to accept the lock cylinder therein and a shoulder to engage the flange of the lock cylinder and hold the cylinder front face recessed from the housing front wall, said body further having a chamber dimensioned to accept the battery;

switch means connected to said second lamp terminal for selectively enabling current flow through said lamp; and conductor means for connecting said outer housing to a first terminal of the battery and for connecting said switch means to a second terminal of the battery.

* * * * *